United States Patent [19]

Bader

[11] 4,202,380

[45] May 13, 1980

[54] DROP PLATE FOR AN ELECTRICAL STOP MOTION OF A WEAVING MACHINE

[75] Inventor: Hartmann Bader, Bad Liebenzell, Fed. Rep. of Germany

[73] Assignee: Sulzer Brothers Limited, Winterthur, Switzerland

[21] Appl. No.: 914,769

[22] Filed: Jun. 12, 1978

[30] Foreign Application Priority Data

Jun. 15, 1977 [CH] Switzerland ..... 7342/77

[51] Int. Cl.[2] ..... D03D 51/32

[52] U.S. Cl. ..... 139/368

[58] Field of Search ..... 139/91, 92, 93, 337, 139/353, 356, 368; 200/61.18, 288, 275

[56] References Cited

U.S. PATENT DOCUMENTS

| | | | |
|---|---|---|---|
| 2,610,656 | 9/1952 | Watson | 139/353 |
| 2,845,953 | 8/1958 | Wagner | 139/92 |
| 3,049,151 | 8/1962 | McFetters | 139/368 |

*Primary Examiner*—Henry Jaudon

*Attorney, Agent, or Firm*—Kenyon & Kenyon

[57] ABSTRACT

Each drop plate has an aperture through which a search bar can pass in order to establish an electrical circuit should a warp yarn break. The plates may be of laminated construction with one or more metal layers and one or more layers of a vibration-damping material such as a plastics. The plates may also be made of a plastics coated metal layer. The plastics layer(s) serve to damp vibrations in the plates and thus reduce noise in the operation of the weaving machines.

12 Claims, 5 Drawing Figures

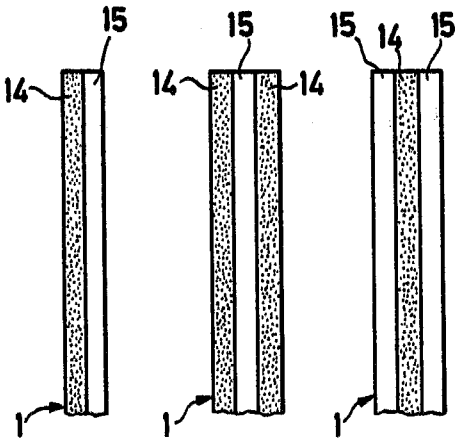
Fig. 4
Fig. 3
Fig. 2
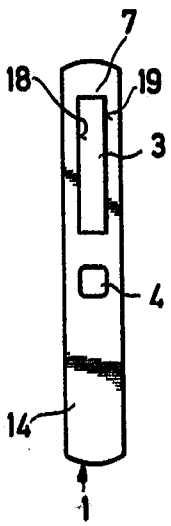
Fig. 5
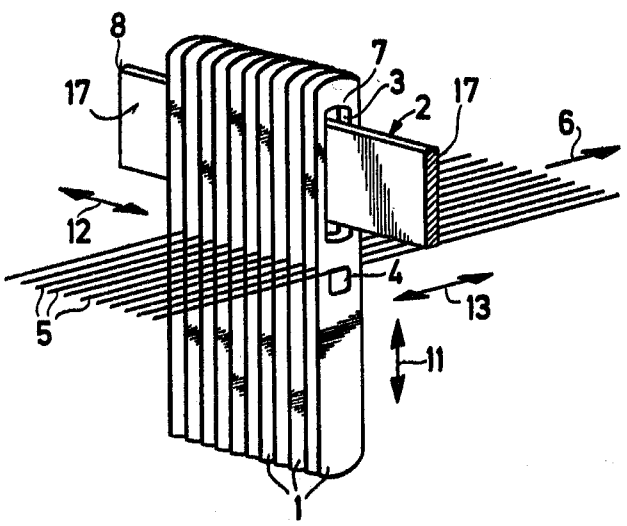
Fig. 1

DROP PLATE FOR AN ELECTRICAL STOP MOTION OF A WEAVING MACHINE

This invention relates to a drop plate for an electrical stop motion, and particularly, for a warp stop motion of a weaving machine.

Heretofore, it has been known to employ drop plates on the warp yarns processed into cloth in weaving machines in order to signal breaks in the warp yarns. Generally, these plates sit on the warp yarns during the machine operation and are strung out along an electrical control element in the form of a bar.

The control element may, for example, be an electrical contact bar (electrical warp yarn motion) which is used to complete a circuit with a drop plate to stop the machine in the event of a yarn breakage. Alternatively, the control element may be a reciprocating rack (mechanical warp yarn stop motion), in which a falling drop plate can engage, so that the machine is again stopped. The following remarks are based, for example, on an electrical warp yarn stop motion.

The known drop plates for electrical warp yarn stop motions usually consist completely of metal material, e.g. sheet steel, as described in German Pat. No. 1,760,945. During use, due to the dynamic stress of the yarns being monitored, e.g. the warp yarns in a weaving machine, and because a large number of such plates, e.g. 5000 to 10000, are usually disposed at relatively close spacings, e.g. of about 1 millimeter in a weaving machine, the metal drop plates continually strike against one another by their surfaces. The drop plates also irregularly strike against the electrical contact parts of the warp yarn stop motion of the weaving machine.

The continuous vibration in a weaving machine is, of course, due to the beating-up of a reed, the reciprocating healds, the warp yarn tensioning beam, which moves to and fro under spring biasing, and other intermittently moving parts of the machine. The drop plate surfaces are thus induced to vibrate at high frequency in many ways and correspondingly give rise to diffused noise.

Accordingly, it is an object of the invention to reduce noise in a waving machine employing drop plates in a stop motion.

It is another object of the invention to provide a drop plate for a stop motion which is capable of suppressing vibrations.

It is another object of the invention to provide a drop plate of simple construction which is able to suppress vibrations in a warp stop motion.

Briefly, the invention provides a drop plate for a stop motion of a weaving machine which includes an aperture for passage of a search bar, a metallic zone around the aperture for effecting an electrical contact with the search bar, and a second zone of vibration damping material, such as a plastics.

In one embodiment, the drop plate is made of laminated construction with one or more layers of metal and one or more layers of vibration damping material extending over the entire length of the drop plate.

In another embodiment, the drop plate is made of a metal layer with a plastic coating surrounding the metal layer while exposing an edge of the metal layer about the aperture for the search bar.

The vibration-damping material may, for example, be polypropylene, polyvinyl chloride (PVC), Teflon (polytetrafluoroethylene, PTFE), rubber or the like.

Tests have shown that the noise from a warp yarn stop motion equipped with drop plates constructed according to the invention can be reduced by some decibels.

In mechanical yarn stop motions, the weight of the drop plate can be increased by the amount of metal, so that the plate drops sufficiently quickly after a yarn breakage. The plate can also be particularly protected from friction on the rack.

These and other objects and advantages of the invention will become more apparent from the following detailed description taken in conjunction with the accompanying drawings in which:

FIG. 1 illustrates a perspective view of the main parts of a warp yarn stop motion according to the invention on a weaving machine;

FIG. 2 illustrates a side view of a single drop plate according to the invention to an enlarged scale;

FIG. 3 illustrates a modified drop plate construction in accordance with the invention;

FIG. 4 illustrates a further modified drop plate according to the invention; and FIG. 5 illustrates a front elevation of another embodiment of a drop plate according to the invention.

Referring to FIG. 1, a warp stop motion is comprised of a relatively large number of drop plates 1, e.g. 8000, which hang on warp yarns 5 which pass through apertures 4 (in the direction of warp movement as indicated by the arrow 6). Each plate 1 has a second aperture 3 through which one or more electrical contact bars 2 are disposed in parallel relationship and of which FIG. 1 shows only one. Also, each plate 1 has a top web 7 extending across the aperture 3 above the contact bar 2.

Each contact bar 2 has two side walls 17 which are connected to one pole of an electrical power supply, the second pole of which is connected to a search bar 8, which projects at the top edge 8 of the bar 2 and which is electrically insulated from the side walls 17.

If a warp yarn 5 breaks during operation, the corresponding drop plate 1 falls until the top web 7 bears on the search bar 8 and one of the side walls 17 is contacted at the same time. Electrical connection is thus established between one side wall 17 and the search bar 8, so that the weaving machine is stopped via known means and the warp yarn breakage can be cleared.

As indicated in FIG. 1, the plates can be induced to vibrate mainly in three orthogonal directions as indicated by the arrows 11, 12, 13.

Referring to FIG. 2, each stop plate 1 is of laminated construction and has a metallic zone formed by a metal plate 15 and a vibration-damping zone formed of a layer 14 of relatively soft plastics material e.g. polypropylene. The two layers 14, 15 are secured together in any suitable manner, for example, adhesively, and may be approximately the same thickness.

Alternatively, as shown in FIG. 3, each drop plate 1 may be formed of one metal layer or plate 15 sandwiched between two layers 14 of vibration-damping material. These two layers 14 may be applied by spraying or gluing.

Referring to FIG. 4, each drop plate 1 may also be formed of one layer 14 of vibration-damping material sandwiched between two metal plates or layers 15. In this case, the intermediate layer 14 which may be made of plastics can constitute an adhesive layer to secure the metal plates 15 together. When the plate 1 undergoes flexural vibrations, the plastics layer 14 undergoes deformation due to shearing forces by the metal layers 15.

Thus, the flexural vibration can be considerably damped and correspondingly little noise is emitted.

Referring to FIG. 5, the stop plate 1 may also be formed of a plastics layer or plate 14 with an inner periphery 18 of the contact rail aperture 3 provided with a metal edge 19. In this construction, the metal edge 19 allows an electrical contact to be formed between the inner edge 19 and the search bar (FIG. 1) when the plate 1 drops. In order to increase the weight of the drop plate 1, the plastics may, for example, be glass-fiber-reinforced. If the plates need not be disposed very close together, they can also be made relatively thick. The plates must have some weight so as to drop rapidly in the event of a warp breakage, so that the weaving machine is stopped as soon as possible thereafter.

In another embodiment, the drop plate can be formed of a metal layer with a plastic layer or coating surrounding the metal layer on all sides, while exposing only the edge 18 of the contact rail aperture 3 so as to have a metal edge 19 as shown in FIG. 5.

What is claimed is:

1. A drop plate for a stop motion of a weaving machine, said drop plate having an aperture for passage of a search bar therethrough, a metallic zone around said aperture for effecting an electrical contact with the search bar, and a strip of vibration-damping material extending over the entire length of the drop plate.

2. A drop plate as set forth in claim 1 wherein said metallic zone is a metal layer in surface-to-surface contact with said strip.

3. A drop plate as set forth in claim 1 having a pair of metal layers and an intermediate adhesive laryer retaining said metal layers together, said intermediate layer defining said strip with said metal layers defining said metallic zone.

4. A drop plate as set forth in claim 1 wherein said metallic zone is a metal layer and said second zone is a plastics coating surrounding said metal layer.

5. A drop plate for a stop motion of a weaving machine, said drop plate being of laminated construction and having a metal layer and a second layer of vibration-damping material adjacent said metal layer, said layers defining an aperture for passage of a search bar therethrough with said second layer extending over the entire length of the drop plate.

6. A drop plate as set forth in claim 5 wherein said second layer is made of a plastics material.

7. A drop plate as set forth in claim 5 which further includes a third layer made of vibration-damping material and wherein said metal layer is sandwiched between said second and third layers.

8. A drop plate as set forth in claim 5 which further includes a third layer made of metal material, and wherein said second layer is sandwiched between said metal layers.

9. A drop plate as set forth in claim 5 which further includes a second aperture for passage of a warp yarn.

10. A drop plate for a stop motion of a weaving machine, said drop plate having a metal layer with a first aperture for passage of a search bar therethrough, a second aperture for passage of a warp yarn and a plastics coating surrounding said metal layer while exposing an edge of said metal layer about said first aperture.

11. A drop plate for a stop motion of a weaving machine, said drop plate being of laminated construction and having a pair of metal layers and a layer of vibration-damping material sandwiched between said metal layers, said layers defining an aperture for passage of a search bar therethrough.

12. A drop plate for a stop motion of a weaving machine, said drop plate being of laminated construction and having a metal layer and a second layer of vibration-damping material adjacent said metal layer, said layers defining a first aperture for passage of a search bar therethrough and a second aperture for passage of a warp yarn.

* * * * *